United States Patent [19]

Hanaoka

[11] 4,164,181

[45] * Aug. 14, 1979

[54] PRINTER

[75] Inventor: Seiji Hanaoka, Shiojiri, Japan

[73] Assignees: Kabushiki Kaisha Suwa Seikosha; Shinshu Seiki Kabushiki Kaisha, both of Tokyo, Japan

[ * ] Notice: The portion of the term of this patent subsequent to Jul. 5, 1994, has been disclaimed.

[21] Appl. No.: 812,301

[22] Filed: Jul. 1, 1977

Related U.S. Application Data

[63] Continuation-in-part of Ser. No. 575,814, May 9, 1975, Pat. No. 4,033,256.

[30] Foreign Application Priority Data

May 9, 1974 [JP] Japan ..... 49-51470

[51] Int. Cl.[2] ..... B41J 1/44

[52] U.S. Cl. ..... 101/99; 101/110; 101/93.22

[58] Field of Search ..... 101/95, 96, 99, 110, 101/93.22, 93.28–93.31, 93.41, 93.42, 93.48

[56] References Cited

U.S. PATENT DOCUMENTS

| | | | |
|---|---|---|---|
| 3,176,610 | 4/1965 | Benson et al. | 101/93.28 |
| 3,261,283 | 7/1966 | Vroom et al. | 101/95 |
| 3,422,754 | 1/1969 | Bakardjiev et al. | 101/99 X |
| 3,605,611 | 9/1971 | Konkel et al. | 101/93.48 |
| 3,664,259 | 5/1972 | Weinkle | 101/99 |
| 3,861,302 | 1/1975 | Mizutani et al. | 101/110 X |
| 3,874,286 | 4/1975 | Ishikawa | 101/95 X |
| 3,875,859 | 4/1975 | Busch | 101/93.28 X |
| 3,884,144 | 5/1975 | Shimodaira | 101/110 X |
| 3,954,055 | 5/1976 | Hanaoka | 101/99 |
| 4,033,257 | 7/1977 | Hanaoka | 101/99 |

*Primary Examiner*—Edward M. Coven

*Attorney, Agent, or Firm*—Blum, Moscovitz, Friedman & Kaplan

[57] ABSTRACT

An improved printer comprising a plurality of character rings provided with a plurality of characters on the respective peripheries thereof and corresponding pluralities of ratchet wheels and pawls. Each ratchet wheel is radially mounted on a character ring and a corresponding pawl is oscillatably mounted for engaging its corresponding ratchet at a preselected interval for stopping its associated character ring when a selected character is located at a predetermined position. Guides are provided for determining the constancy of oscillation of the pawls. Each pawl is spring driven into engagement with a corresponding ratchet wheel and a normal bias toward a corresponding ratchet wheel is provided. A releasable restraint acts oppositely to the bias on the pawl for normally preventing the pawl from engaging with its corresponding ratchet wheel. An electromagnetic device is provided for transducing an electronic signal into a mechanical motion which releases the restraint on the pawl whereby the bias on the pawl drives the pawl into engagement with its corresponding ratchet wheel and the character ring associated therewith is thereby fixed for aligning a preselected character in the strike path of an actuable platen. At a print command the platen abuts the character in its path and a paper or like imprint receiver is provided with an imprint of the preselected character.

7 Claims, 14 Drawing Figures

PRINTER

CROSS REFERENCE TO RELATED APPLICATION

This is a Continuation-in-Part of application Ser. No. 575,814, filed May 9, 1975 now U.S. Pat. No. 4,033,256.

BACKGROUND OF THE INVENTION

This invention relates to printers, and in particular to electrically responsive printer devices. Conventional printers are cumbersome and erratic. Moreover, parts replacements are frequently required and the complexities of the devices, in general, foreshorten their useful lives. There is, therefore, an expanding need for rapid, efficient and compact printers. Fabricators of these devices constantly seek an optimal balance among rapidity, efficiency and accuracy.

SUMMARY OF THE INVENTION

Generally speaking, in accordance with the invention, there is provided an improved printer comprising a plurality of character rings provided with a plurality of characters on the respective peripheries thereof and corresponding pluralities of ratchet wheels and pawls. Each ratchet wheel is radially mounted on a character ring and a corresponding pawl is oscillatably mounted for engaging its corresponding ratchet at a preselected interval for stopping its associated character ring when a selected character is located at a predetermined position. Guides are provided for determining the constancy of oscillation of the pawls. Each pawl is spring driven into engagement with a corresponding ratchet wheel and a normal bias toward a corresponding ratchet wheel is provided.

A releasable restraint acts oppositely on the bias on the pawl for normally preventing the pawl from engaging with its corresponding ratchet wheel. An electromagnetic device is provided for transducing an electronic signal into a mechanical motion which releases the restraint on the pawl whereby the bias on the pawl drives the pawl into engagement with its corresponding ratchet wheel and the character ring associated therewith is thereby fixed for aligning a preselected character in the strike path of an actuable platen. At a print command the platen abuts the character in its path and a paper or like imprint receiver is provided with an imprint of the preselected character.

Accordingly, it is an object of this invention to provide an improved printer.

Another object of the invention is to provide a printer with a high degree of accuracy, and a high degree of efficiency.

A further object of the invention is to provide a printer with a compact assembly which is easy to disassemble for part replacements.

Still another object of the instant invention is to provide an improved arrangement for a printer wherein a spring member is utilized to mount a character ring to a drive shaft.

Still another object of the instant invention is to provide a printer whereby only a pulse input to the electromagnet is required to effect a print selection of the character ring.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
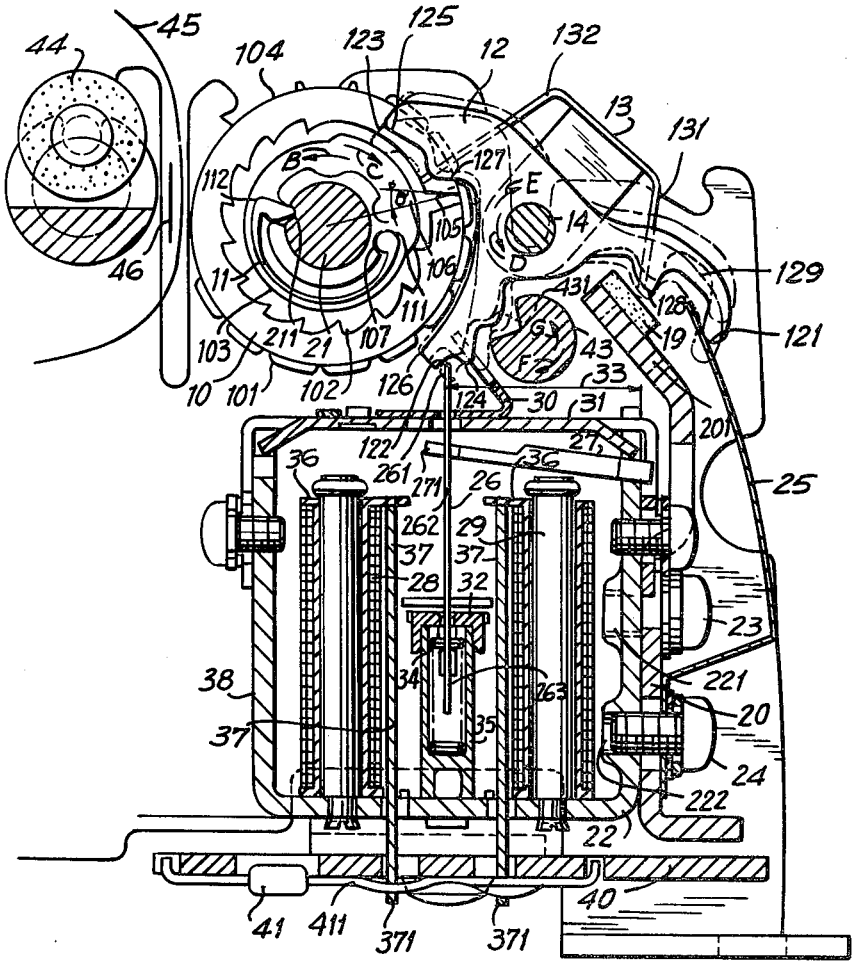
FIG. 1 is a sectional side elevation of a printer constructed in accordance with the instant invention.

Referring now to FIG. 1, a plurality of character rings 10 are arranged independently of each other corresponding to a predetermined number of columns. Character rings 10 are provided with respective pluralities of characters 101 such as letters or symbols on their respective peripheries. Characters 101 of each ring 10 correspond respectively, to teeth of a ratchet wheel 102, which is mounted on a side of each character ring 10. Each character ring 10 is rotatably mounted on a shaft 21. A spring 11, mounted in an interior slot 103 provided in ratchet wheel 102, has a bent portion 111 engaged in a recess 107 provided in character ring 10 and another bent portion 112, freely engageable in a notched groove 211 provided in shaft 21, along the thrust direction of shaft 21. Shaft 21 is connected to a power source (not shown) and driven thereby for rotating shaft 21, respectively in directions C and B. Concomitantly, shaft 21 is stopped when power to the source is shut off. The elastic force of spring member 11 continuously biases bent portion 112 toward the center of the shaft 21, and the resiliency of portion 112, of the spring is notched groove 211, determines a substantially fixed relationship among notched groove 211, characters 101 and character ring 10, and the teeth of the ratchet wheel 102.

A pawl 12 is respectively rotatably mounted in corresponding relationship to each character ring 10. Pawl 12 is oscillatable on a support shaft 14 between a pair of slots 131 and 132 provided in a guide member 13. Pawl 12 is rotatable on shaft 14 for engaging a tooth of ratchet wheel 102 for thereby stopping a character 101 on character ring 10 at a desired position.

Leakage of magnetic flux from a yoke 22, of an electromagnetic device 38, is prevented by a mounting plate 20 made of a non-magnetic material. Mounting plate 20 is fixedly connected between two frames (not shown) for maintaining a predetermined distance therebetween and for providing a rigid support for the printing device. The mounting plate 20 is provided with an upstanding inwardly turned portion 201 on which an elastic member 19 is fixedly connected. In yoke 22, a female screw 221 is tapped and fixedly connected to mounting plate 20 by a screw 23. Additionally, a female screw 222 is tapped in the yoke 22 and an elastic plate provided with comb-shaped springs 25 is mounted on the exterior surface of plate 20 by screw 24. Each spring 25 engages a crook 121 provided in a respective pawl 12 and provides pawl 12 with a moment for rotating about shaft 14 in a direction D.

When pawl 12 is biased in direction D, a tail portion 122 of each pawl 12 engages an end 261 of a restraining member 26. In a slot 262, provided in each restraining member 26, an end 271 of an electromagnetically attractive plate 27 is mounted. Each restraining member 26 upstands respectively through a slot provided in a first guide member 30 and comb-shaped slot provided in a second guide member 31, while the downwardly extending end thereof is housed in an elongated slot provided in third guide member 32. In the device a predetermined distance 33 is established between plate 20 and restraining member 26. A tail portion 263 of the downwardly extended end of restraining member 26 is mounted in a compression spring 34 housed in a housing 35, and constantly biased upwardly thereby.

When an electric current is applied to the electromagnetic coil 28, a corresponding plate 27 is attracted toward a corresponding iron core 29, and thereby moves restraining member 26 downwardly. The bias of restraining member 26, against tail portion 112 of pawl 12, is released as restraining member 26 is moved downwardly, and pawl 12 is rotated in a direction D by the bias of member 25. If portion 122 of pawl 12 is substantially parallel to the direction of movement of restraining member 26, pawl 12 begins to rotate only when restraining member 26 disengages from end portion 261 thereof. Pawl 12 thereby rotates from its normal position to the position shown in phantom line 123 wherein pawl 12 engages a tooth of ratchet wheel 102 for selecting a character 101. When tail portion 122 has a parallel formation relative to the direction of movement of restraining member 26, the period of rotation is longer than when tail portion 122 has an arbitrarily inclined formation against which restraining member 26 biases tail portion 122 for preventing rotation of the pawl in direction D. Therefore, it is preferable to provide tail portion 122 with an inclined formation to shorten the rotation time of pawl 12 and provide a more efficient means for selecting a character.

Restraining members 26 are positioned by fixing the position of yoke 20 with a screw 23, the respective ends 261 of restraining members 26 being kept in contact with projections 124 of pawls 12. However, if an end 261 of a corresponding restraining member 26 rigidly abuts a tail portion 122, at the peak of its incline, it takes longer for pawl 12 to rotate and character selection reliability thereof is reduced. If the engagement between end 261 and tail portion 122 is too elastic, on the other hand, the engagement therebetween is insufficiently shock resistant. The provision of projections 124 adjacent to tail portion 122 provides for a desirable degree of engagement between restraining member 26 and pawl 12.

Coil bobbins 36 are mounted on first print base plates 37. When the iron cores 29 are fixed in yoke 22, coil bobbins 36 and first print base plates 37, are mounted in yoke 22. Two rows of iron cores 29 are arranged zigzag in yoke 22 at regular intervals. A second print base plate 40 is fixed in yoke 22. Second print base plate 40 is provided with electronic elements generally designated 41 having lead terminals 411 connected to projections 371 provided in first print base plates 37. Electric current is provided to electromagnetic coils 28 through second print base plate 40 and first print base plate 37.

A return shaft 43 is angularly reciprocally rotated by a cam member or the like (not shown), for rotating pawl 12 in a direction E. A platen 44 is arranged for impressing paper 45 against a character 101 through a ribbon 46 for thereby obtaining a character imprint thereon.

Figure 2:
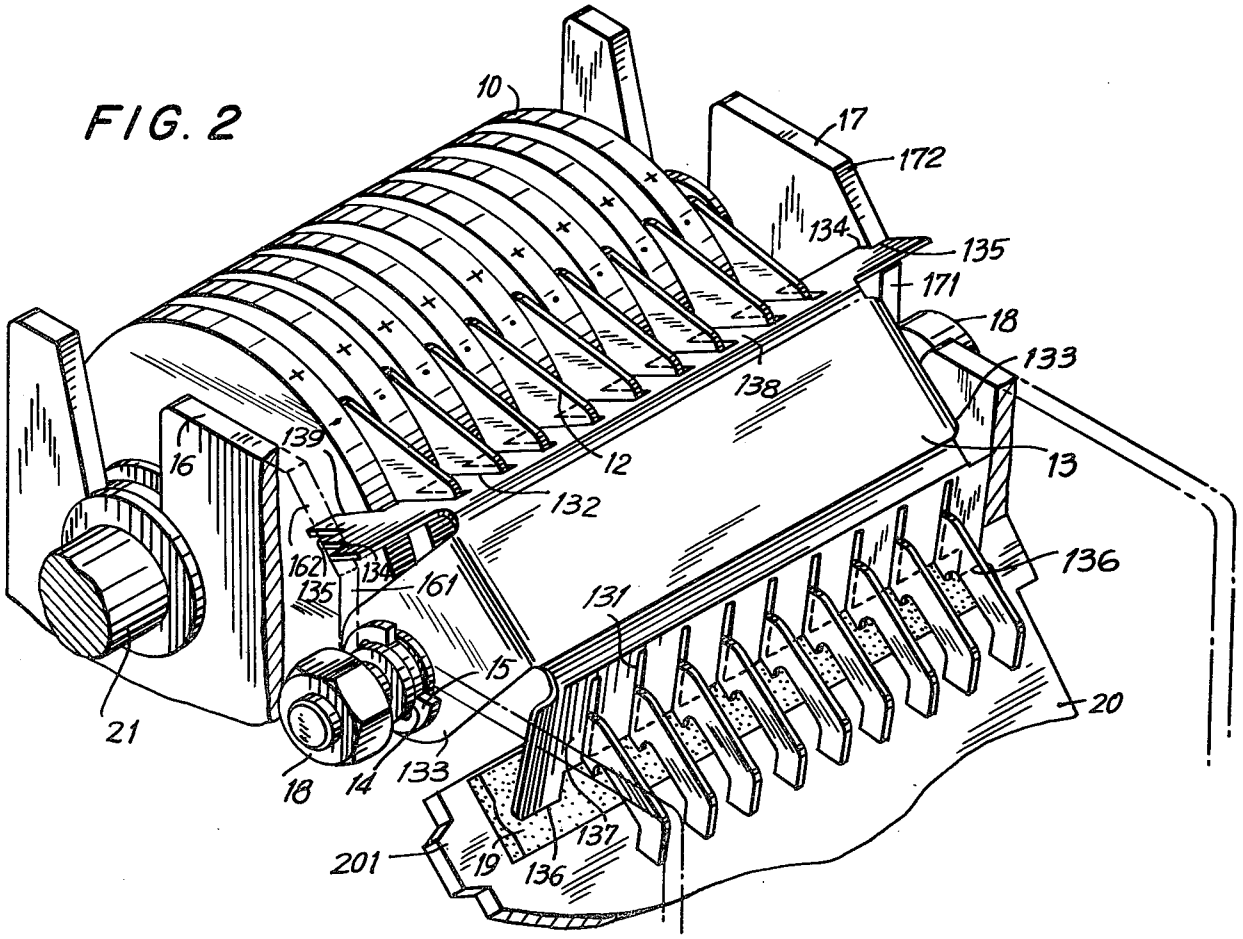
FIG. 2 is a perspective view showing in detail the pawl and pawl guide mechanism of the device.

FIG. 2 illustrates a means for guiding pawls 12. A pawl guide member 13, having substantially a U-shape, includes a first leg 137, a second leg 138, and a pair of opposed inwardly turned members 133 for mounting pawl guide member 13 on shaft 14. Each pawl 12 is mounted on shaft 14 and is guided by corresponding aligned slots 131 and 132 provided respectively in the first and second legs 137 and 138. Pawl 12 is rotatable on shaft 14 through slots 131 and 132. Pawl guide member 13 is mounted on shaft 14 and inwardly turned members 133 thereof provide the connection. Ring shaped stoppers 15 are fitted on shaft 14 for preventing pawl guide member 13 from slipping therefrom.

The assembly of shaft 14, pawls 12 and pawl guide member 13 is releasable from the device and is easily hand-carried and remountable on frames 16 and 17. Leg 138 has a pair of parallel faces 134 for defining a width approximately equal to an inside interval between the frames 16 and 17. When shaft 14 is fixed in a groove 161, of the frame 16 and a groove 171 of the frame 17 with nuts 18, parallel faces 134 are guided along the inside surfaces of frames 16 and 17 and movement of pawl guide member 13, in the direction of rotation of shaft 14, is controlled by the inside surfaces of the frames 16 and 17, and, is concomitantly small. Accordingly, pawls 12 are arranged correspondingly by reference to frames 16 and 17. Stoppers 135, provided on leg 138, are stopped against an edge 162, provided on frame 16, and an edge 172, provided on frame 17, while projections 136 of leg 137 are stopped against elastic member 19 which is, for instance, fabricated of rubber and adhesively connected to member 201, provided on mounting plate 20. As mounted, elastic member 19 is elastically deformed due to the mounting of pawl guide member 13 thereover.

Due to its elasticity, elastic member 19 has a movement which exerts a bias on pawl guide member 13 and stoppers 135 are thereby constantly biased against edge 162 of frame 16 and edge 172 of frame 17, so that no circumferential play of pawl guide member 13 against shaft 14 occurs.

Each of the character rings 10 pivotably mounted on shaft 21 is guided between a pair of pawls 12. However, the end ring proximate frame 16, is guided between a pawl 12 and a nub 139 provided in leg 138 of pawl guide 13. Therefore, its movement in the thrust direction of shaft 21 is limited. Accordingly, the positions and the pitch of character rings 10 are not determined by any guide means, but rather by pawls 12 and pawl guide 13.

Figure 3:
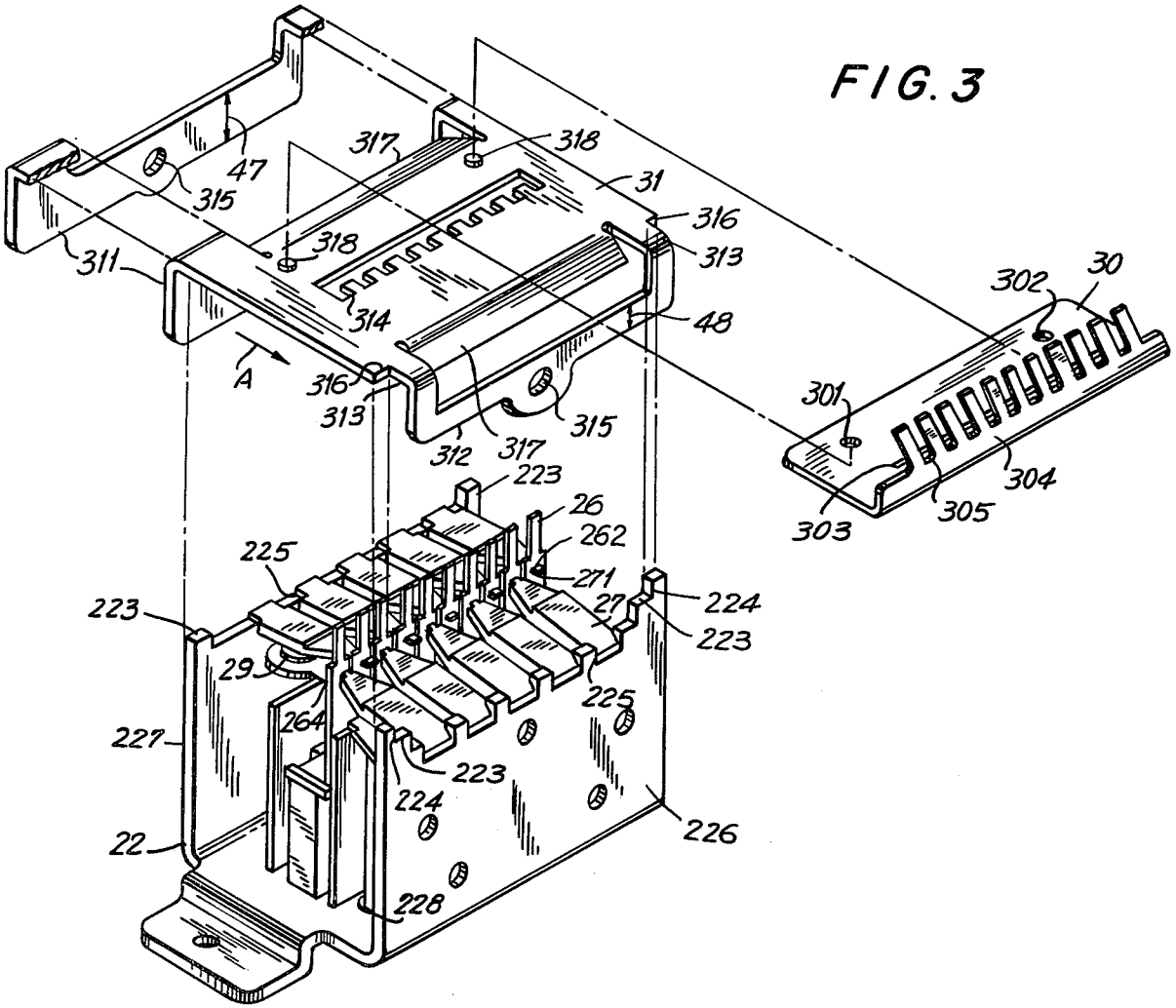
FIG. 3 is an exploded view showing the restraining means for biasing and releasing the pawls employed in the device.

FIG. 3 illustrates a method of mounting first guide member 30 and second guide member 31. Yoke 22 has a U-shape and includes a first leg 226 and a second leg 227. Leg 226 is fixedly mounted on plate 20 by screw 23, as seen in FIG. 1. Legs 226 and 227 are provided with a plurality of guide grooves 225 for accommodating plates 27. Plates 27 are arranged in correspondence with iron cores 29 which are mounted zigzag at regular intervals on the yoke 22. Ends 271 of plates 27 are mounted in a respective plurality of apertures 262 provided in restraining members 26. Legs 226 of yoke 22 includes a pair of parallel edge faces 224 which are perpendicular to the pitch of restraining members 26. Additionally, legs 226 and 227 include four coplanar supports 223.

Second guide member 31 includes comb-shaped slots 314 substantially centrally located therein and a pair of columnar projections 318 which are substantially parallel with the line of comb-shaped slots 314. Further included therein are a first mounting foot 311, a second mounting foot 312 and angularly turned member 317 which are respectively parallel with slots 314. A width 47 of first mounting foot 311 is wider than a width 48 of the second mounting foot 312. Both mounting feet are provided with a mounting aperture 315. Additionally, second guide member 31 includes a pair of stopper faces 316 parallel with slots 314, and a pair of parallel edge faces 313.

When second guide member 31 is mounted on supports 223, parallel edge faces 313 are mounted between edge faces 224, and restraining members 26 are mounted in respective slots 314. Parallel edge faces 224, of yoke 22, control the play of the second guide member 31 in a direction parallel to the line of restraining members 26, and the play thereof is small. Slots 314, in second guide member 31, determine the pitch of restraining members 26. When stopper faces 316 contact leg 226 of yoke 22, gaps are provided between first mounting foot 311 and second leg 227, as well as between second mounting foot 312 and first leg 226. First mounting foot 311 is fixedly connected to a second leg 227 by a screw (not shown) threaded through the mounting aperture 315, and similarly, second mounting foot 312 is fixedly connected to a first leg 226. Since the width 47 of first mounting foot 311 is wider than the width 48 of second mounting foot 312, there odcurs a difference in resilient force caused by the bending. Accordingly, second guide member 31 is biased forwardly in a direction A, with its stopper faces 316 being continuously pressed closely against first leg 226. Thus, the surface of first leg 226, which contacts plate 20, shown in FIG. 1, and columnar projections 318, are located a predetermined distance apart.

First guide member 30 includes an aperture 301, an elliptic aperture 302 and a slot 303. It further includes an arm 304 bent in parallel with slot 303, and arm 304 is provided with comb-shaped guide grooves 305. Columnar projections 318, provided in second guide member 31, are mounted in aperture 301 and elliptic aperture 302, provided in first guide member 30, whereby first guide member 30 is nested on second guide member 31. Slot 303, which is parallel with first leg 226, guides restraining member 26 which is mounted therein. Guide grooves 305, provided in arm 304, correspond, respectively, to slots 314, provided in second guide member 31. Each guide groove 305 prevents a corresponding pawl 12, as shown in FIG. 1, from being disengaged from a restraining member 26, since a portion of pawl 12 proximate tail portion 122 thereof is mounted in guide groove 305.

Stopper faces 316, of second guide member 31, are fixed against first leg 226 of yoke 22 whereby the distance 33, as seen in FIG. 1, may be predetermined. If, in FIG. 1, the distance 33 is incorrect, then tail portion 122 of pawl 12 and end 261 of the corresponding restraining member 26 will engage at an undesirable position. If the distance 33 is larger than desirable, pawl 12 will rotate through a larger angle for selecting a character, and it will take a longer time for pawl 12 to engage a corresponding tooth of ratchet wheel 102. On the other hand, if the distance 33 is too small, then an engaging portion 125 of pawl 12 intrudes into the path of a tooth of the ratchet wheel and the tail portion 122 and end 261 engage each other, thereby interrupting the normal functional operation of the device.

Figure 4:
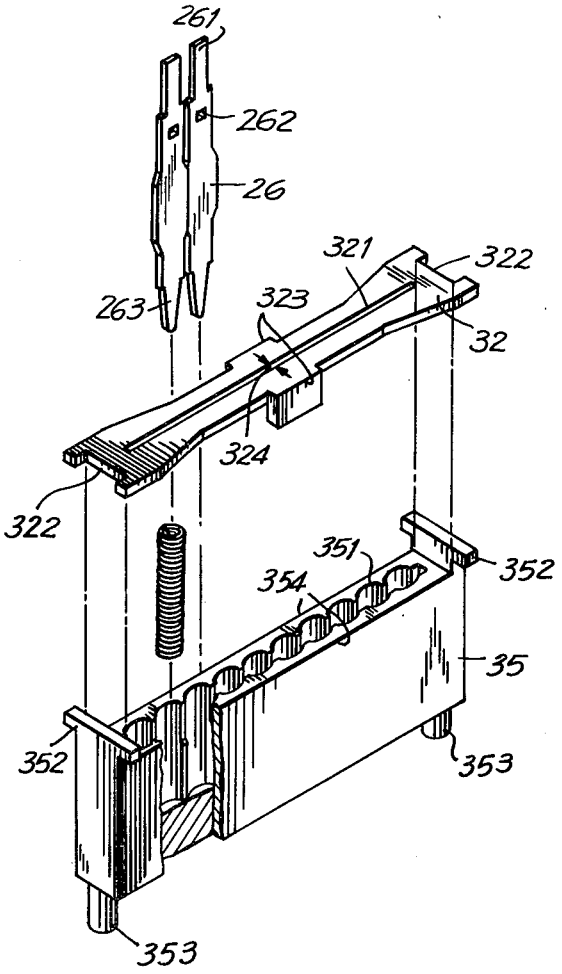
FIG. 4 is an exploded view showing a means for moving the restraints on the pawls upwardly and downwardly.

As seen in FIG. 4, a portion of each restraining member 26 proximate tail portion 263 thereof is guided in slot 321 of third guide member 32. Guide member 32 is mounted on supporter 35 in such a way that recesses 322, provided in guide member 32, engage respective T-shaped shoulders 352 in supporter 35, and compression springs 34 are housed in respective cylindrical channels 351, provided in supporter 35. Since guide member 32 is resilient, it is deformed when its ends are mounted under shoulders 352 of supporter 35, and returns to a flat position after it is mounted. Projections 323 of guide member 32 bridge across both sides 354 of supporter 35, therefore, if the central width 324 of slot 321 of guide member 32 is narrowed, it may be widened to a predetermined distance by the projections 323. Supporter 35 is connected to yoke 22 as seen in FIG. 1, in such a way that columnar projections 353 are mounted in apertures (not shown) provided in yoke 22.

Respective tail portions 263 of restraining members 26 are mounted in compression springs 34 and normally biased upwardly as seen in FIG. 1.

Figure 5:
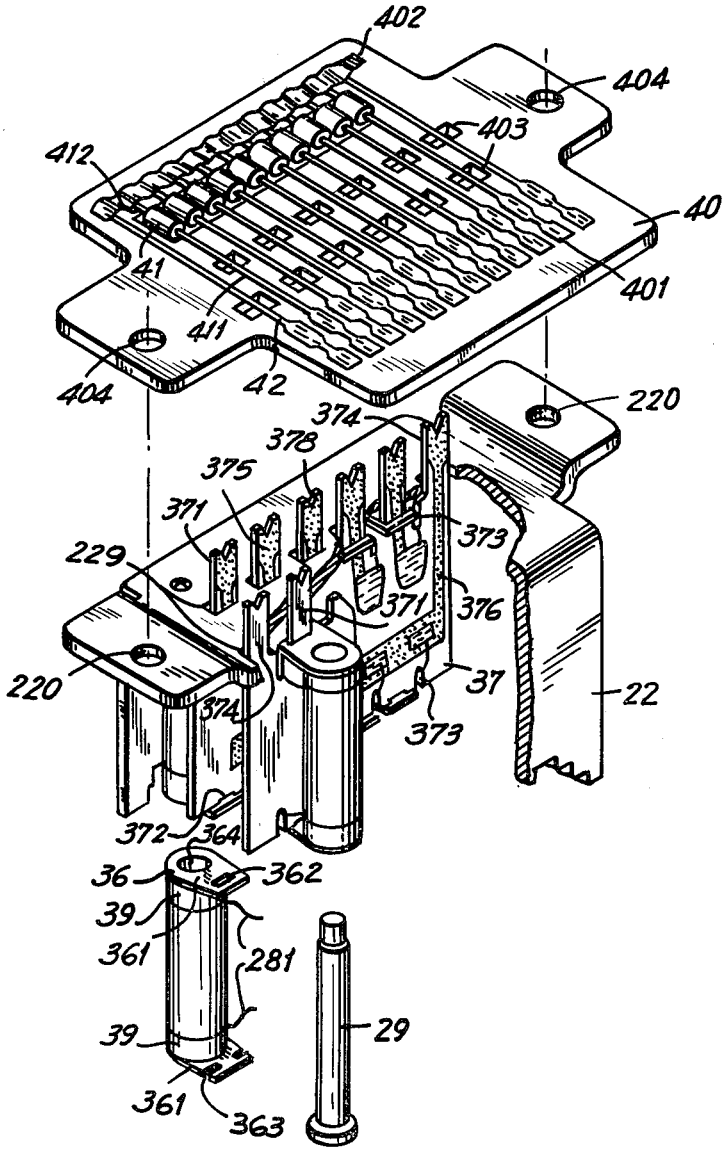
FIG. 5 is a perspective view showing a means for actuating the electromagnetic coils in the device and thereby transducing an electrical signal to a mechanical action of the pawl restraints.

As seen in FIG. 5, flanges 361 of the bobbin 36 are provided with an aperture 362 and notches 363. Coil terminal leads 281 of electro-magnetic coil 28 wound around bobbin 36, as ssen in FIG. 1, are withdrawn at a distance from flanges 361 by tapes 39.

Each of the first print base plates 37 has first projections 371 disposed at regular pitches, mounting grooves 372, each of which corresponds to each of the first projections 371, and a second projection 374 next to the line of the first projections. The first and second projections, respectively, 371 and 374 are provided with grooves 378 at respective upper ends thereof. A groove 373 is provided adjacently to each first projection 371 and each mounting groove 372. A first copper foil 375 and a second copper foil 376 are provided on first projections 371 and the second projection 374, respectively, extending into groove 378 of each.

Each bobbin 36 is mounted on first print base plate 37 whereby first projection 371 is fitted into mounting aperture 362 of bottin 36 and notches 363 are engaged with the mounting groove 372. The two coil terminal leads 281, of each coil, are soldered to independent first copper foil 375 and to common second copper foil portion 376 through the grooves 373. The two opposite first print base plates 37, with mounted bobbins 36, are mounted in yoke 22 whereby first projections 371 and second projections 374 extend through apertures 229 of yoke 22, and iron cores 29 mounted in apertures 364 of bobbins are connected to yoke 22. The two lines of first projections 371 are disposed zigzag when mounted on yoke 22 at regular intervals, as well as iron cores 29.

Second print base plate 40 is provided with first copper foil portions 401 and second copper foil portions 402. Lead terminals 411 and 412 of electronic elements 41, opposite ends of conductive wires 42 on either side thereof are soldered to independent first copper foil portions 401 and common second copper foil portions 402. The second print base plate is further provided with apertures 403 and mounting apertures 404.

First projections 371 and second projections 374 are mounted through apertures 403 whereby grooves 378, of first projections 371, hold lead terminals 411 of elements 41 and grooves 378 of second projections 374 hold conductive wires 42. Lead terminals 411 are soldered to first copper foil portions 375 of the first print base plates 37, and conductive wires 42 are soldered to the second copper foil portions 376 thereof.

The second print base plate 40 is connected to yoke 22 by screws, or the like, through the mounting apertures 404. When a voltage is applied across the conductive wire 42 and the first copper foil portion 401 of the second print base plate 40, a current is applied to the corresponding coil 28, as seen in FIG. 1.

In practice, shaft 21 is partially surrounded by a torsion coil spring (not shown) which rotationally biases shaft 21 in the direction B. A part of the shaft 21 (not shown) is biased against an externally mounted stopper (not shown) for maintaining the stability of shaft 21. On a print command, shaft 21 is rotated in the direction C by an external driving means, (not shown) with the torsion coil spring, (not shown) being wound up. When inwardly turned portion 112 of spring 11 is in notched groove 211 of shaft 21, portion 112 of spring 11 is biased against notched groove 211 by the elastic force of spring member 11. Accordingly, shaft 21 and character ring 10 are rotated in direction C since they are associated with each other in a predetermined relation.

Immediately before a preselected character 101, which is to be printed, passes a position facing a platen 44, a current is applied to electro-magnetic coil 28, through second print base plate 40, and first print base plates 37 whereby plate 27 is attracted towards iron core 29. Consequently, restraining member 26 is biased downwardly against the resiliency of compression spring 34. Since tail portion 122, of pawl 12, is inclined, it is rotated in direction D by the action of spring 25 engaged in crook 121 of pawl 12 as restraining member 26 is urged downwardly. When tail portion 122 of pawl 12 completely disengages from end 261 of restraining member 26, pawl 12 is rotated freely to phantom position 123 whereby pawl 12 engages a tooth of ratchet wheel 102 corresponding to a preselected character 101 for stopping character ring 10 in a predetermined position, whereby preselected character 101 faces platen 44. End 261 of restraining member 26 is caught by an edge 126 of pawl 12. Shaft 21 continues to rotate after pawl 12 stops character wheel 101 and portion 112 of spring 11 disengages from notched groove 211 and oscillates shaft 21 at its circumference.

While shaft 21 is rotated in the direction C through a predetermined angle of rotation, respective characters 101 of the columns to be printed are aligned facing platen 44, and for the columns of the print out which are to remain blank, spaces 104 lacking characters 101, are provided and aligned facing the platen. After shaft 21 is rotated in direction C through the predetermined angle or rotation, it is stopped by an arresting member (not shown) and platen 44 is biases against aligned characters 101 through ribbon 46 and print paper 45 for obtaining a print out.

After the print out is obtained, return shaft 43 is rotated in a direction F for rotating pawl 12 in direction E whereby segment 125 thereof is removed from the rotational path of the teeth of ratchet wheel 102. When return shaft 43 is rotated to phantom position 431, pawl 12 is rotated slightly in direction E from its solid line position wherein it is engaged with end 261 of restraining member 26. Simultaneously, restraining member 26 is biased upwardly by compression spring 34, and end portion 261 thereof is positioned for engagement with tail portion 122. Thus, pawl 12 is reset.

After pawl 12 has been reset, shaft 21 which has been constrainted is released from the arresting means (not shown). Shaft 21 thereby rotates in direction B due to the torque of the torsion coil spring which built-up therein when shaft 21 was rotated in direction C. Character ring 10, of unprinted columns, are rotated simultaneously with shaft 21 as segments 112 of corresponding spring members 11 are mounted in notched grooves 211. Other character rings 10, of printed columns, are biasingly rotated in direction B when corresponding segments 122 are mounted in notched groove 211 of shaft 21, however, initially character rings 10 are stopped, or rotated slightly in direction B, due to relative sliding on the circumference of shaft 21 and the bias of segments of spring member 11.

When shaft 21 is rotated in direction B, to the position as shown in FIG. 1, shaft 21 is stopped almost instantaneously by an externally mounted stopper (not shown) against which a portion of shaft 21 (not shown) abuts. Since each character ring 10 has a kinetic energy due to inertia, each is respectively rotatable in direction B further than is desirable, therefore, a stopper 105 is provided on ratchet wheel 012 which abuts an extension 127 of pawl 12. After its initial abutment against extension 127, stopper 105 slides upwardly along extension 127 and rotates pawl 12 in direction E to a phantom position 129. The kinetic energy of the character ring 10 is thereby absorbed by elastic member 19, which is distorted by a second extension 128, provided in pawl 12. Stopper 105 is inclined against the radial direction of the character ring 10 by an angle $\theta$ generally designated by numeral 106 for protecting stopper 105 from wear by providing a relatively long side of the stopper 105 along extension 127. Stopper 105 is additionally protected against wear by elastic member 19 which absorbs the kinetic energy of character ring 10. Although the character ring 10, which has just rotated the pawl 12 to phantom position 129, is positioned in such a way that the bent portion 112, of spring member 11, is partially out of notched groove 211, the character ring 10 returns to the position shown due to the elastic force of spring member 11 exerted towards the center of the shaft whereby the bent portion 112 thereof fits into notched groove 211 again.

Return shaft 43 is rotated in a direction G from phantom position 431 to the position as shown by the solid line. Thus, a series of printing operations may be accomplished.

Figure 6A:
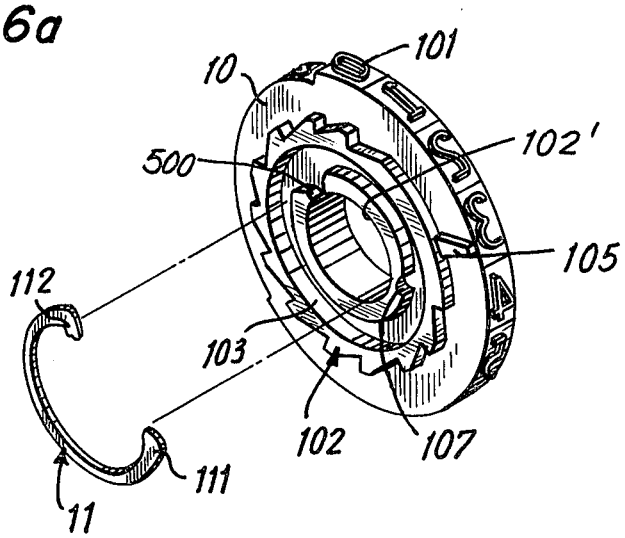
FIG. 6*a* is an exploded perspective view of the character ring mounting assembly in accordance with a first embodiment thereof.
Figure 6B:
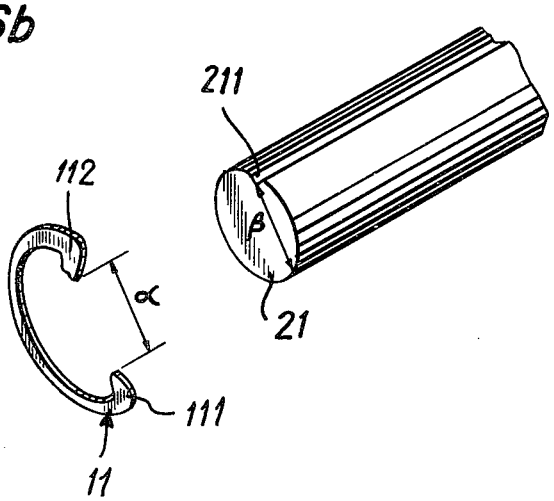
FIG. 6*b* is a perspective view of the drive shaft and spring member of FIG. 6*a*.

Referring now to FIGS. 6*a* and 6*b*, the mounting of a character ring 10 on shaft 21 by means of spring member 11 is illustrated in greater detail. As described above, spring member 11 is mounted within recess 103 in ratchet wheel 102 against an annular wall 102', which annular wall is integrally formed with the character ring and includes a recess 107 formed therein. First bent portion 112, of spring member 11, rides in further notch 500 in the annular wall 102' to thereby permit bent portion 112 to also ride in notched groove 211 formed in drive shaft 21. A second bent portion 11, of spring member 11, rides in recess 107 and is maintained out of engagement with drive shaft 21. Resiliency is imparted to bent portions 112 and 111 of spring member 11 in order to secure character ring 10 to shaft 21. This construction, nevertheless, permits the bent portion 112 to be disengaged from the notched groove 211, when pawl 12 is in engagement with ratchet wheel 102. Resiliency is imparted to the bent portions 112 and 111 by providing a distance $\alpha$ between the bent portions 111 and 112 of spring member 11 is less than or equal to the diameter $\beta$ of shaft 21 measured from the notched groove 211 through the center of shaft 21, expressed mathematically as $\alpha \leqq \beta$.

Figure 7:
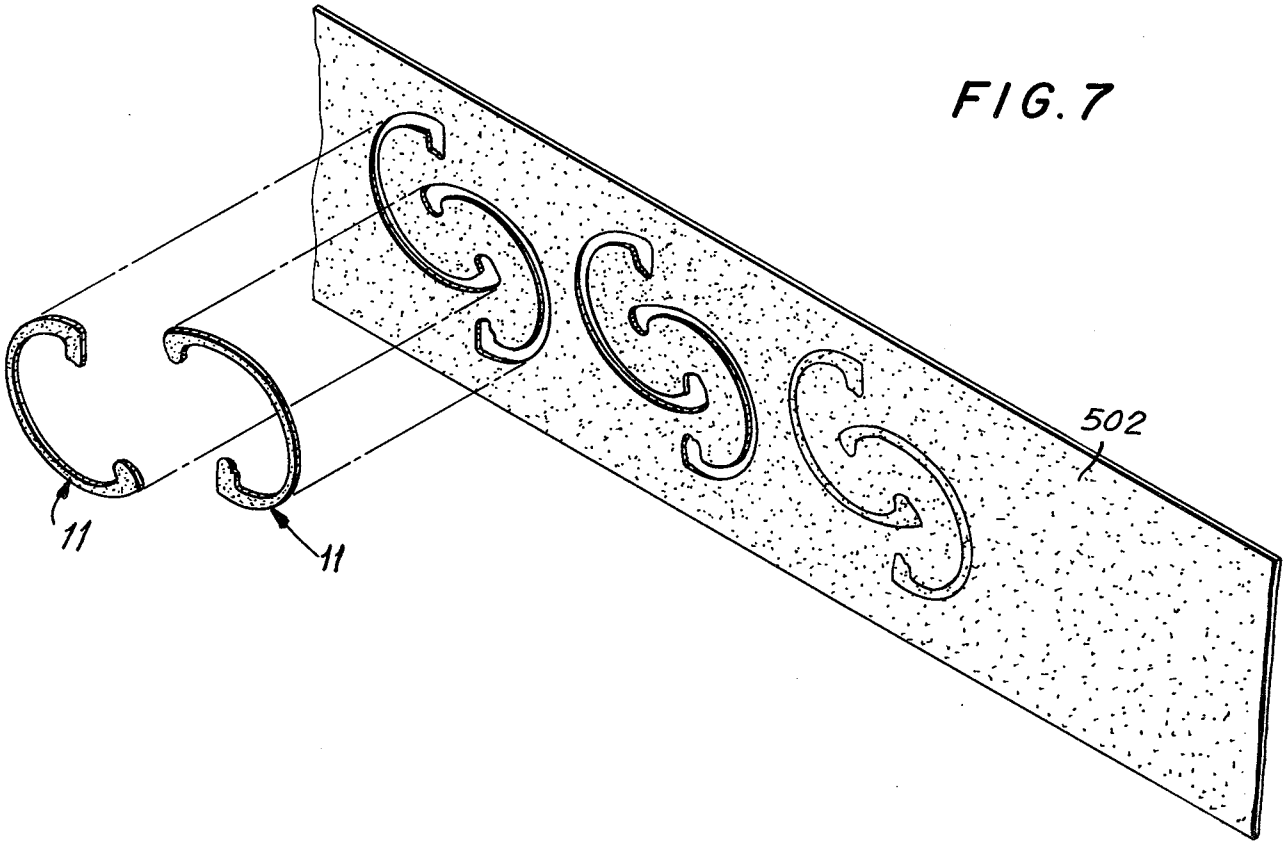
FIG. 7 is a perspective view of the steps of forming the spring members depicted in FIGS. 6*a* and 6*b;*

A spring member 11, having the configuration detailed above, can easily be mass produced and assembled. As is illustrated in FIG. 7, a planar web of spring material 502 may be utilized to produce a number of spring members 11 by punching, cutting or otherwise forming the springs from a planar web 502. The configuration of spring members 11, as depicted in the drawings, allows same to be produced from the planar web 502 without the need for any complex bending or shaping steps during manufacture.

Reference is now made to FIGS. 8 through 12, wherein a character ring mounting and pawl mechanism, constructed in accordance with still another preferred embodiment of the instant invention, is depicted, like reference numerals being utilized to denote like elements detailed above. Specifically, FIGS. 8*a* and 8*b* illustrate still another spring mounting mechanism for character ring 10. Annular wall 102' is provided with openings 108 and 109 for permitting bent portions 115 and 144 of spring member 11' to directly engage shaft 52. Drive shaft 52 corresponds to drive shaft 21, discussed above, and effects a mounting of each of the character rings 10. However, unlike shaft 21, shaft 52 is not grooved. Bent portions 115 and 114, of the spring member 11', differ from the bent portions 111 and 112 of spring member 11. Specifically, their tips 114' and 115' are concave to thereby correspond to the curvature of shaft 52 so that tips 114' and 115' can be readily disposed in engagement with shaft 52. The tips 114' and 115' of bent portions 114 and 115 are displaced into engagement with shaft 52, through notches 108 and 109, in annular wall 102', by the resiliency of spring member 11. This resiliency may be derived from the relationship between the distance $\alpha'$ between bent portions 114 and 115 and the diameter $\beta'$ of shaft 52 so that $\alpha'$ is less than $\beta'$, expressed mathematically as $\alpha' < \beta'$.

Spring member 11' is engaged with shaft 52 by the absolute value of the difference of $\alpha'$ substracted from $\beta'$, expressed mathematically as $|\beta'-\alpha'|$. Accordingly, the rotation of shaft 52 is transmitted to character ring 10 by the friction engagement of the tips of the bent portions of the spring member 11 secured to the character ring 10.

Figure 8A:
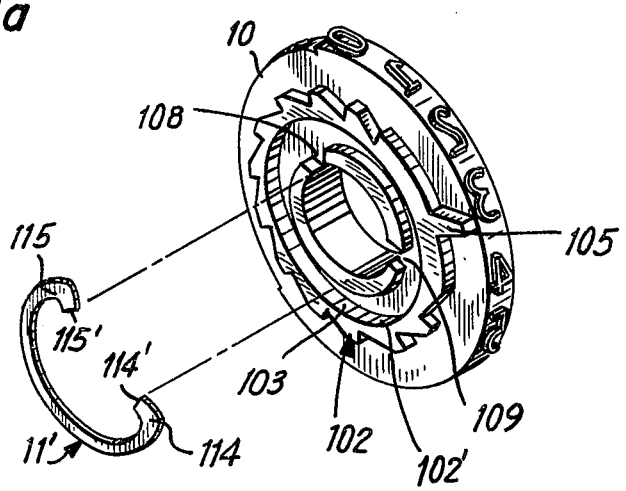
FIG. 8*a* is an exploded perspective view of a character ring mounting assembly constructed in accordance with a second embdiment of the instant invention.
Figure 8B:
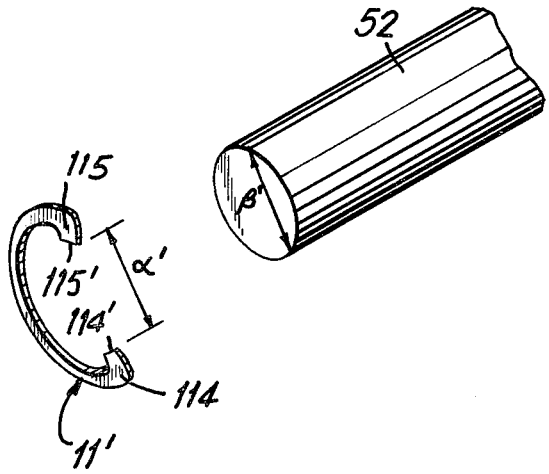
FIG. 8*b* is a perspective view of the rotatable drive shaft and spring member of the mounting assembly of FIG. 8*a;*
Figure 9:
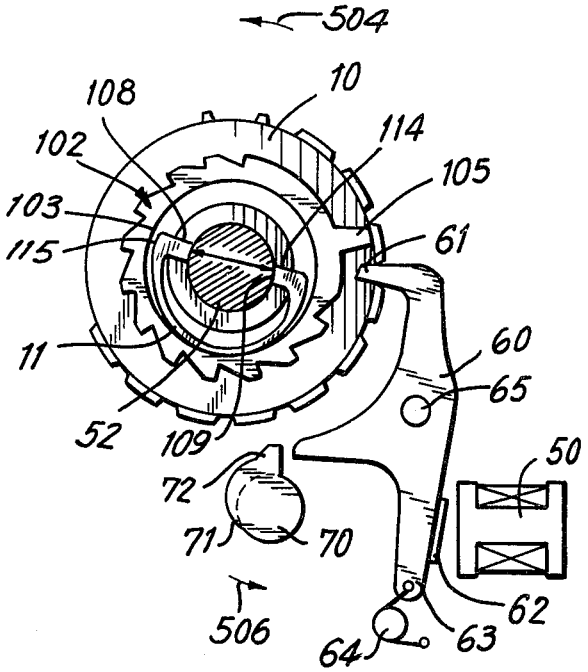
FIG. 9 is an elevational view of the character selection mechanism including the drive shaft and spring member depicted in FIGS. 8*a* and 8*b;*
Figure 10:
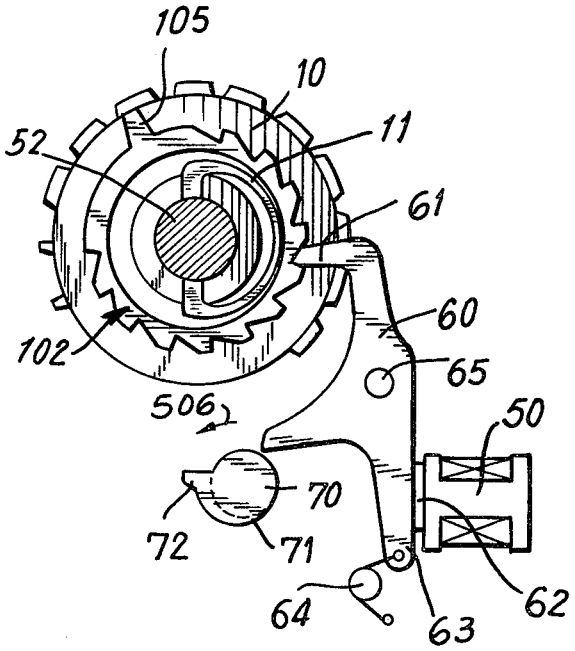
FIG. 10 is an elevational view of the character selection mechanism depicted in FIG. 9, in a selection state.
Figure 11:
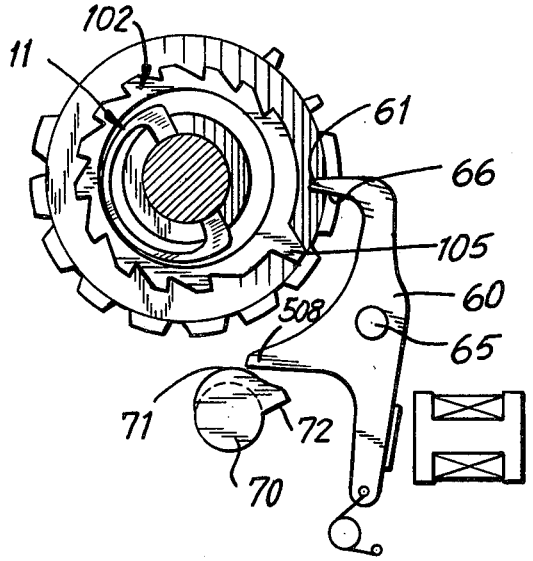
FIG. 11 is an elevational view of the character selection mechanism depicted in FIG. 9, with the pawl disengaged from the teeth of the ratchet wheel.

Referring specifically to FIGS. 9 through 12, a pawl mechanism for use with the spring and shaft arrangement, illustrated in FIGS. 8*a* and 8*b*, is depicted. A character selection lever 60 is pivotally mounted about a shaft 65 and includes a pawl portion 61 at the first end and an extension 63 carrying a plate 62 at its other end. An electro-magnet 50 is disposed proximate to a magnetically permeable plate 62 for attracting the plate 62 when the electro-magnet 50 is energized. A rest position of the lever 60, when the printer is in a pre-selection state is illustrated in FIG. 9. The lever 60 is maintained in a rest position when the electro-magnet 50 is deenergized so that the pawl portion 61 of lever 60 is disposed out of engagement with ratchet wheel 102 to thereby permit the character ring 10 to be rotated in a direction 504 by the rotation of shaft 54 in the same direction by means of the spring member 11', in the manner described above.

When the tooth of ratchet wheel 102, corresponding to the character to be printed, approaches the position of pawl portion 61, of selection lever 60, the electromagnet 50 is energized to attract plate 62 of selection lever 60 and thereby pivot lever 60 about pivot 65 in the same rotational direction as the rotational direction of the shaft 65. Rotation of lever 60 results in pawl portion 61 engaging the tooth of ratchet gear 102 to thereby place the character selection mechanism in a selection state whereby the lever is disposed in a print position, illustrated in FIG. 10.

When pawl portion 61 engages the specific tooth on ratchet wheel 102, the rotation of the character ring 10 is stopped. However, tips 114' and 115' of spring member 11 will continue to slide along the periphery of the shaft 52 and permit shaft 52 to continue rotating. Selection lever 60 is biased into both its rest position, illustrated in FIG. 9, and its print position, illustrated in FIG. 10, by means of a bistable spring 64. The bistable action performed by spring 64 eliminates the necessity of keeping the electro-magnet 50 energized during the entire period that the selection mechanism is in a selection state and deenergized only when the mechanism is in a pre-selection state. A pulse input to the electromagent 50, having a duration sufficient to lock character ring 10, in its desired position, is all that is required. It is noted that although spring 64 operates as a bistable means, any other mechanism, for example a solenoid containing a permanent magnet, can be used to effect bistable control. After the engagement of pawl portion 61 with the desired tooth on ratchet wheel 102, the printing cycle is performed by the action of the platen 44 in the manner previously described.

Figure 12:
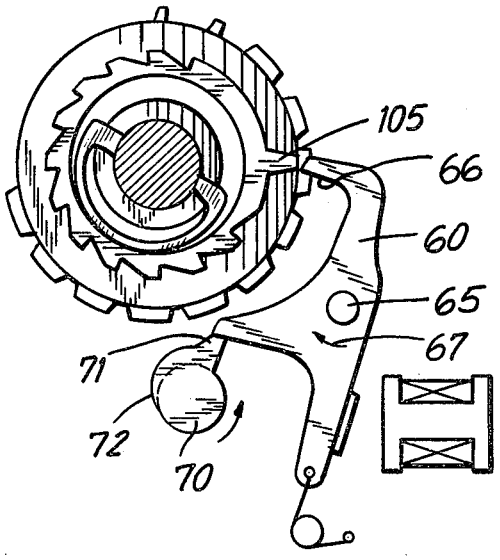
FIG. 12 is an elevational view of the character selection mechanism depicted in FIG. 9, with the cam projection disengaging the pawl from the stop tooth of the ratchet wheel.

Disengagement of pawl portion 61, from engagement with tooth on ratchet wheel 102, is accomplished by means of a cam 70. Cam 70 is synchronized with shaft 52 to effect one rotation of cam 70 for every two rotations of shaft 52. Cam 70 includes a first curved camming surface 71 and a camming projection 72, the purpose of which will hereinafter be described. After the printing cycle has been completed, camming surface 71, on cam 70, will approach an extension 508 of selection lever 60 and displace it to a clearance position, illustrated in FIG. 11. In a clearance position, pawl portion 61 will be out of engagement with the teeth of ratchet wheel 102 to permit character ring 10 to again be rotated by shaft 52. Thus, as character ring 10 rotates, stopper 105 will approach and contact stopper face 66 of pawl portion 61. When stopper 105 is in contact with stopper face 66 of pawl portion 61 of selection lever 60, character ring 10 will again be prevented from rotating while shaft 52 rotates, and in this manner, each character ring 10 will be aligned at the same angular position, to permit the printing cycle to be completed. Once each character ring is aligned, the stopper face 66 of pawl portion 61 is disengaged from stopper 105 by means of projection 72 on each cam 70. As is illustrated in FIG. 12, each of the projections 72 will pivot selection levers 60 in the direction 67 to disengage the stopper portion 66 of pawl portion 61 from engagement with stopper 105 to return the levers to a rest position and, hence, the mechanism to its preselection state, illustrated in FIG. 9.

It is noted that an improved printer, constructed in accordance with the preferred embodiment of the instant invention, provides a simple and economical mechanism for transmitting rotary motion of the shaft 52 to the character ring 10 and permits a spring member 11 to be utilized which is easily mass produced from a flat web of resilient material.

As above-described, an improved printer constructed according to this invention includes relatively few component elements and is compact. Accordingly, the size of this improved printer is reduced and assembly thereof is facilitated. Furthermore, this improved printer is efficient, accurate and has a long useful life.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved printer for printing a web of paper comprising rotatable drive shaft means, at least one character ring having a plurality of characters on the periphery thereof, each said character ring being supported on said drive shaft means, spring coupling means having a pair of opposed ends that are resilient with respect to each other, said spring coupling means being mounted to each said character ring for engaging said drive shaft means, each said character ring having a ratchet wheel disposed thereon, pawl means associated with each said character ring, each said pawl means being coordinately displaceable between a rest position and a print position, means for coordinately displacing each of said pawl means between said rest and print positions, each said pawl means being adapted to engage said ratchet wheel on said associated character ring when said pawl means is in said print position to thereby stop the rotation of said character ring, said spring coupling means permitting said drive shaft means to continue rotating after said character ring is stopped, and including a projection on each of said opposed ends of said spring coupling means for engaging said drive shaft means, the distance between said first and second projection being $\alpha$, said diameter of said drive shaft means being $\beta$, and $\alpha \leqq \beta$.

2. An improved printer, as claimed in claim 1, wherein said spring coupling means has a C-shaped configuration.

3. An improved printer as claimed in claim 1, wherein each said projection is shaped to conform with the outer periphery of said drive shaft means.

4. An improved printer as claimed in claim 1, wherein said means for coordinately displacing said pawl means are electro-magnetic means.

5. An improved printer as claimed in claim 4, wherein each said pawl means includes a magnetic permeable member.

6. An improved printer as claimed in claim 1, and including resetting means for resetting each of said pawls from a print to a rest position, said resetting means including cam means for engaging said pawl means when said pawl means are engaged with said ratchet wheel.

7. An improved printer for printing on a web of paper comprising rotatable drive shaft means, at least one character ring having a plurality of characters on the periphery thereof, each said character ring being supported on said drive shaft means, for being rotated from an initial position to a print position, coupling means mounted to each said character ring, each said coupling means being adapted to engage said drive shaft means, each said character ring having a ratchet wheel disposed thereon, said ratchet wheel including at least one stop tooth projecting therefrom, pawl means associated with each said character ring, each said pawl means being at least displaceable between a rest position and a print position, means for displacing said pawl means between a rest position and a print position, each said pawl means being adapted to engage said ratchet wheel on said associated character ring when said pawl means is in said print position to thereby stop the rotation of said character ring at a print position, said pawl means including reset projection formed thereon, and a rotatable reset cam having a first surface adapted to engage said reset projection formed on said pawl means and displace said pawl means from a print position to a clearance position, said stop tooth being adapted to engage a portion of said pawl means when said ratchet wheel is rotated toward said initial position and engages said portion of said pawl means disposed in said clearance position, said reset cam having a further camming surface for engaging said reset projection on said pawl means when said pawl means is disposed in said clearance position for displacing said pawl means from said clearance position to said rest position, so that said pawl means is out of engagement with said stop tooth, to thereby dispose each of said character rings in its initial rotational position.

* * * * *